US006299291B1

(12) United States Patent
Marusak

(10) Patent No.: US 6,299,291 B1
(45) Date of Patent: Oct. 9, 2001

(54) ELECTROSTATICALLY SWITCHED INK JET DEVICE AND METHOD OF OPERATING THE SAME

(75) Inventor: Ronald E. Marusak, New Milford, CT (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/675,301

(22) Filed: Sep. 29, 2000

(51) Int. Cl.[7] ..... B41J 2/04
(52) U.S. Cl. ..... 347/54
(58) Field of Search ..... 347/54, 68, 69, 347/70, 71, 72, 50, 40, 20, 27, 39; 399/261; 361/700; 310/328–330; 29/890.1

(56) References Cited

U.S. PATENT DOCUMENTS 4,459,601 7/1984 Howkins .
4,520,375 5/1985 Kroll .
4,646,106 2/1987 Howkins .
5,534,900 7/1996 Ohno et al. .
6,130,689 * 10/2000 Choi ..... 345/55

* cited by examiner

*Primary Examiner*—Raquel Yvette Gordon
(74) *Attorney, Agent, or Firm*—Lisa M. Soltis; Mark W. Croll; Donald J. Breh

(57) ABSTRACT

Electrostatic attraction serves as a glue between a piezoelectric actuator and a flexible wall of the fluid chamber. A single actuator which can be shared among channels, provides the effort to drive ink out of the nozzle. The electrostatic field can be switched on and off; and so, individual channels are selectively clamped to the actuator only when those channels are to eject drops.

30 Claims, 6 Drawing Sheets

ELECTROSTATICALLY SWITCHED INK JET DEVICE AND METHOD OF OPERATING THE SAME

FIELD OF THE INVENTION

The present invention relates generally to fluid jet devices, and more particularly, to ink jet apparatus and ink jet printer heads, and methods of operating the same.

BACKGROUND OF THE INVENTION

Ink jet printers are known as a type of non-impact printer which has no physical contact with the surface on which it is printing. As the name "ink jet" suggests, an ink jet printer projects a jet of ink out of the print head through free air onto a surface to be printed. Due to its ability to print on various shaped and textured surfaces without contact, the ink jet technology finds new applications daily, especially in all types of industries which rely upon product marking, coding, dating or identification. Ink jet printing (text and graphic) has also developed considerably.

Ink jet technology falls into two main categories. One is continuous ink jet technology, according to which a stream of ink is continuously circulating from the body of the printer through the print head and back to the body of the printer. The ink is broken into drops at the nozzle and then deflected by electric charge to either reach the target or end up in a return block. The other technology is drop-on-demand, according to which droplets of ink are forced out of the nozzle only when needed, at an appropriate time. In some cases, the ink is ejected by heating a resistor which causes an air bubble to expand. When the bubble collapses, the droplet breaks off and the system returns to its original state. In other cases, the ink is ejected under pressure pulses caused by mechanically induced volumetric changes in the ink.

A typical drop-on-demand type ink jet printing system of the latter case is disclosed in U.S. Pat. No. 4,459,601 to Howkins. In Howkins, the volume of an ejection chamber is varied by a piezoelectric transducer that communicates with a moveable wall of the ejection chamber. The transducer expands and contracts to drive ink out through an orifice. A printing control voltage is applied to electrodes placed across the piezoelectric transducer to induce the expanding or contracting movements of the transducer.

Generally, in the above Hawkins structure, the transducers are placed in predetermined positions through an adhesive agent or the like to attach to the ejection chambers. Particularly in high quality printers, it is desirable to design an increased number of the nozzles for ejecting ink drops in an ink jet printer head. Since the dimension of the ink jet printer head is limited, the transducers, arranged in a densely packaged array, must be as small as possible. Therefore, in the case of a high-density ink-jet recording apparatus having a large number of nozzles, there is a limitation from the viewpoint of accuracy in aligning and bonding the transducers to their respective moveable walls. The adhesive layer interposed between the moveable wall and the piezoelectric transducer may lower the driving efficiency of the ink jet apparatus as well.

In addition, the conventional ink jet apparatus utilizes a separate transducer for each channel. A pair of electrical electrodes must also be formed individually in each transducer. Accordingly, to construct such a printer head, a large number of individual parts must be used, and a large number of steps are required to assemble the array. For these reasons, it has heretofore been impractical to manufacture a very high density ink jet printer head.

SUMMARY OF THE INVENTION

It is, therefore, an object of the present invention to provide an ink jet apparatus which tolerates some degrees of misalignment between the transducer and the chamber without sacrificing accuracy.

It is a further object of the present invention to provide an ink jet apparatus which eliminates the need for a physical adhesive bond between the transducer and the chamber, thus, improving the driving efficiency of the ink jet apparatus.

It is a further object of the present invention to provide an ink jet apparatus which utilizes common transducers and chambers yet achieves the above objects.

It is a further object of the present invention to provide an ink jet printer head in which a single transducer can be shared among several channels, thus reducing the number of parts to be used and simplfying the assembling process in the manufacture of the ink jet printer head.

These and other objects of the present invention are achieved by the use of electrostatic attraction to bind the moveable wall of the ejection chamber to the transducer. In accordance with an aspect of the invention, a fluid jet apparatus comprises a fluid chamber and an actuator. The fluid chamber has a nozzle and a flexible wall capable of vibrating to alter a volume of the fluid chamber. The actuator generates mechanical movements according to a control signal. The flexible wall and the actuator are coupled by electrostatic coupling arrangements, thereby the mechanical movements of the actuator are transformed into vibrations of the flexible wall.

The foregoing objects of the present invention are also achieved by an ink jet apparatus comprising an ink chamber and an actuator. The ink chamber includes a nozzle, an inlet, and a flexible wall. Electrostatic coupling arrangements are provided for creating an electrostatic bond between the flexible wall and the actuator. Thus, when the actuator moves, the flexible wall is deformed to force ink out through the nozzle and to draw ink in through the inlet. In accordance with an aspect of the invention, the electrostatic coupling arrangements comprises a pair of electrodes which are attached directly or indirectly to an edge of the actuator and to the outer surface of the flexible wall.

The foregoing objects of the present invention are also achieved by an ink jet printer head comprising a plurality of ejection chambers, at least one motion driving element, and a coupling control circuit. Each ejection chamber has a nozzle, an inlet, and a flexible wall. There is a plurality of first electrostatic coupling members each associated with one flexible wall. At least one second electrostatic coupling member is also provided for the at least one motion driving element. The coupling control circuit selectively generates electrostatic bonds between selected first electrostatic coupling members and the at least one second electrostatic coupling member. Therefore, when the at least one motion driving element moves, only the flexible walls associated with the selected first electrostatic coupling members are deformed to force ink out through their nozzles and to draw ink in through their inlets. In accordance with an aspect of the invention, the electrostatic coupling members are electrodes which are attached directly or indirectly to an edge of the at least one motion driving element and to the outer surfaces of the flexible walls.

The foregoing objects of the present invention are also achieved by a method of operating an inkjet apparatus. The ink jet apparatus includes an ink chamber with a flexible wall, and an actuator. In accordance with the method, an electrostatic bond is generated between the flexible wall and the actuator. Next, the flexible wall is deformed in response to a movement of the actuator in a first direction. In accordance with an aspect of the invention, the flexible wall then returns to its original state either in response to a movement of the actuator in a second direction, or when the electrostatic bond is removed.

The foregoing objects of the present invention are also achieved by a method of operating an ink jet printer head. The inkjet printer head includes a plurality of ejection chambers, and at least one actuator. In accordance with the method, electrostatic bonds are selectively generated between flexible walls of selected ejection chambers and the at least one actuator. Next, selected flexible walls are deformed in response to a movement of the at least one actuator in a first direction. In accordance with an aspect of the invention, the selected flexible walls then return to their original states either in response to a movement of the at least one actuator in a second direction, or when the electrostatic bonds are removed. Therefore, ink is jetted from the selected ejection chambers only.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

BEST MODE FOR CARRYING OUT THE INVENTION

Figure 1:
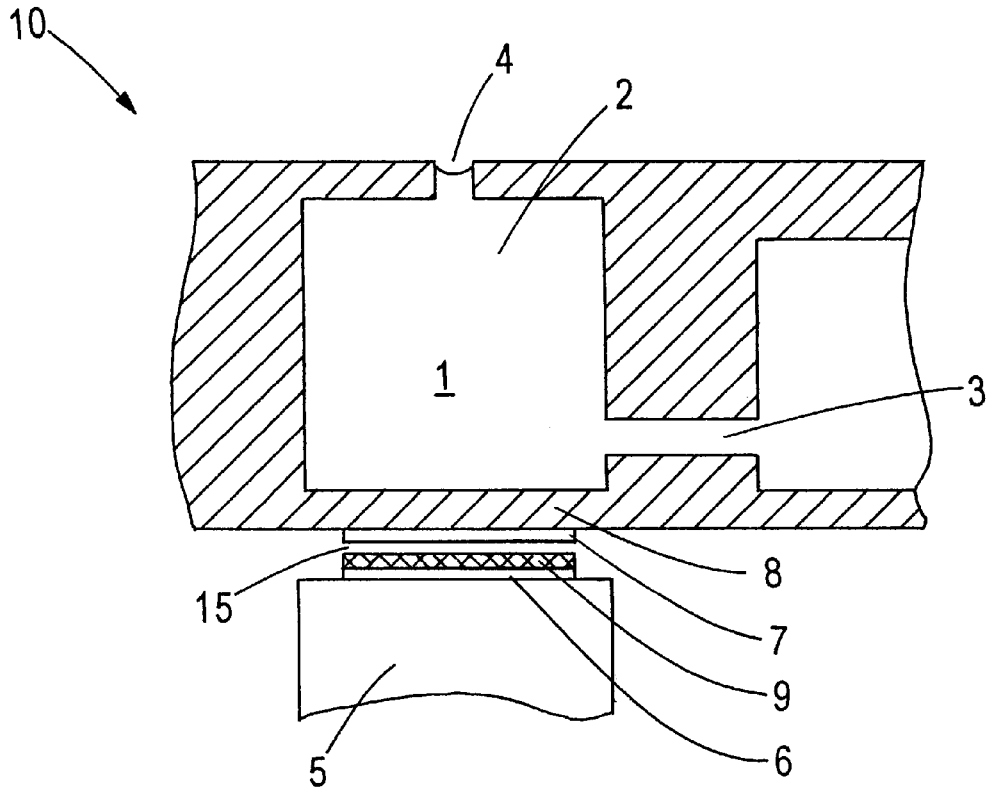
FIG. 1 is a schematic sectional view of an ink jet apparatus in accordance with an embodiment of the present invention.

An ink jet apparatus for use in an ink jet printer head and a method of operating the same according to the present invention are described. In the following detailed description, for purposes of explanation, numerous specific details are set forth in order to provide a thorough understanding of the present invention. It will be apparent, however, that the present invention may be practiced without these specific details. In other instances, well-known structures and devices are shown in block diagram form in order to simplify the drawing.

Referring to FIG. 1, an ink jet apparatus 10 comprises a chamber 1 and an actuator The chamber 1 is filled with ink 2 which is ejected through a nozzle 4, created on a wall of the chamber 1, to form a pixel on a target (not shown). Ink 2 is supplied to the chamber 1 through an inlet 3 which communicates with an ink reservoir (not shown). The chamber 1 further has a flexible wall 8 which vibrates to vary the volume of the chamber 1. When the volume of the chamber 1 decreases, the ink pressure inside the chamber 1 increases, forcing ink 2 out through the nozzle 4. On the contrary, when the volume of the chamber 1 increases, the ink pressure inside the chamber 1 decreases, drawing ink 2 in through the inlet 3. Though it has been shown in FIG. 1 that the nozzle 4 is formed on a wall opposite the flexible wall 8 and the inlet 3 is formed on a side wall of the chamber 1, various arrangements are readily contemplated by those of ordinary skill in the art. Other details, such as shape, material or dimension, of structural components of the chamber 1 are also well known and need not be recited herein.

The ink jet apparatus 10 utilizes mechanical movements of the actuator 5 to drive vibrations of the flexible wall 8. Again, details, such as type, shape, material or dimension, of the actuator 5 are well known and need not be recited herein. For example, the actuator 5 can be made of a piezoelectric material which expands or contracts when a voltage is applied across it. Though it has been shown in FIG. 1 that the actuator 5 is placed coaxial with the chamber 1 with an edge facing and slightly apart from flexible wall 8, various arrangements are readily contemplated by those of ordinary skill in the art. It is also understood that the actuator 5 is not necessary to move along the central axis (not shown) of the chamber 1.

To transform the movements of the actuator 5 into the vibrations of the flexible wall 8, the ink jet apparatus of the invention utilizes an electrostatic bond in the form of attraction forces of an electrostatic field. The electrostatic field is generated between a first electrode 6 and a second electrode 7 when a voltage is applied thereto. Those of ordinary skill in the art will easily realize many arrangements of the first and the second electrodes to provide a sufficient strong electrostatic bond between the actuator 5 and the flexible wall 8.

In the embodiment shown in FIG. 1, the first electrode 6 is formed on the close edge of the actuator 5 while the second electrode 7 is formed on the outer surface of the flexible wall 8. An insulator 9 is placed between the pair of electrodes 6 and 7 to prevent a short circuit. Preferably, the second electrode 7 and the insulator 9 are of types which do not interfere with the vibrations of the flexible wall 8. For example, the insulator 9 of the ink jet apparatus 10 shown in FIG. 1 is attached to the first electrode 6, and there is a small gap 15 between the insulator 9 and the second electrode 7. Other arrangements when the insulator 9 is in contact with the second electrode 7 instead of the first electrode 6, or when the insulator 9 is attached to the second electrode 7 are, however, not excluded. The second electrode 7 may be formed as a thin film over the outer surface of the flexible wall 8 by well known techniques in the art. As an alternative, the second electrode 7 and the flexible wall 8 may be incorporated into a single body.

Figure 2A:
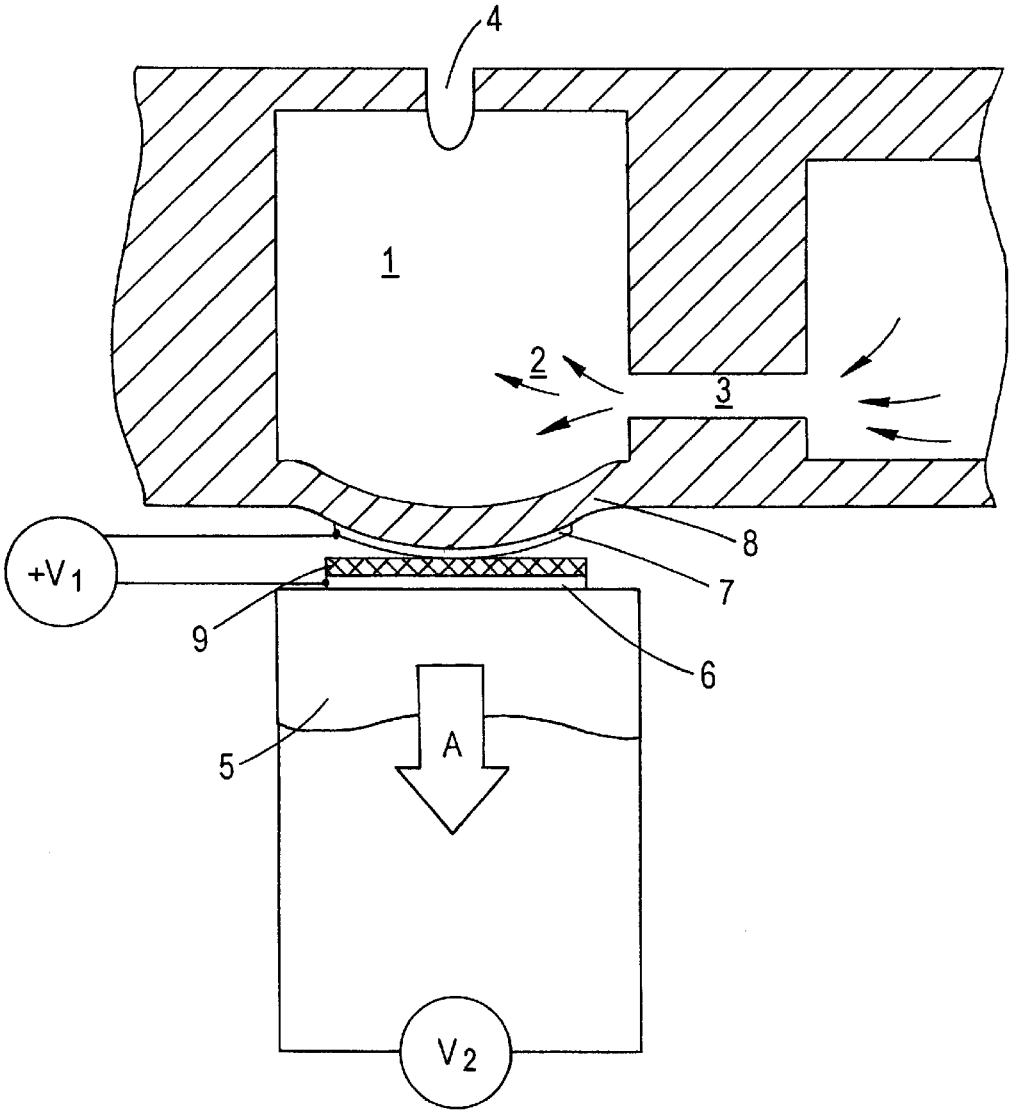
FIGS. 2A through 2C are schematic sectional views illustrating the sequential operation of the ink jet apparatus shown in FIG. 1.
Figure 2B:
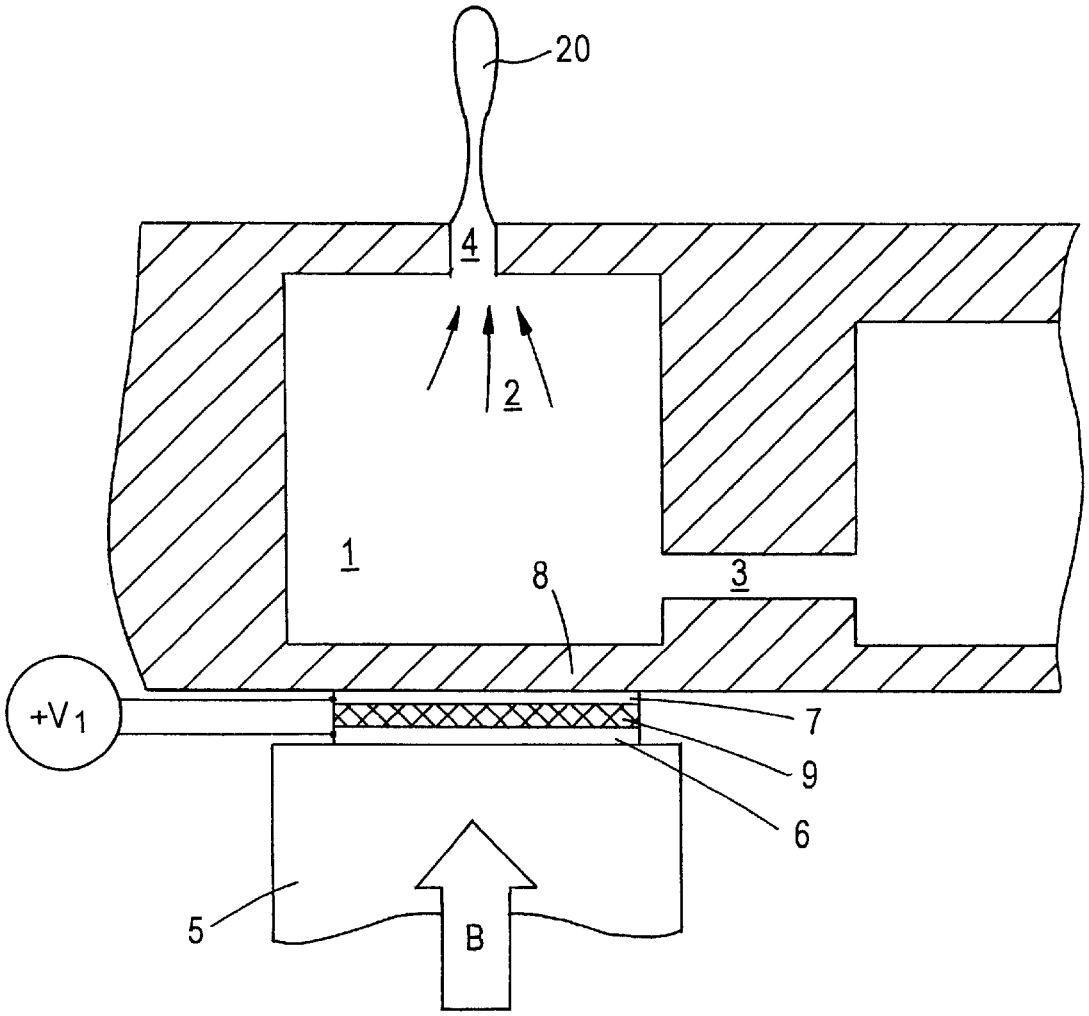
Figure 2C:
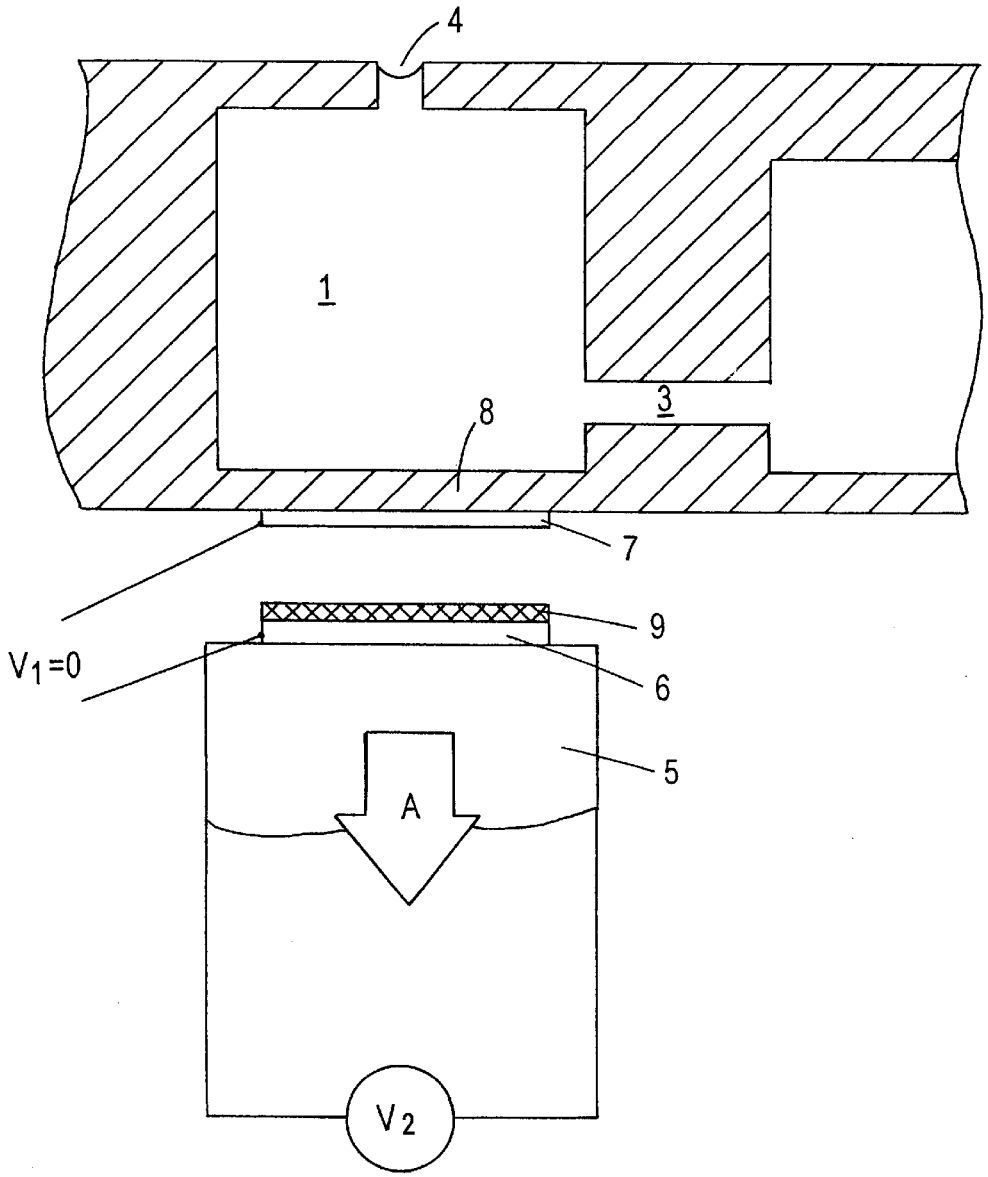

The operation of the ink jet apparatus 10 will be best understood with reference to FIGS. 2A–2C. As shown in FIG. 2A, when a voltage different $V_1$ is applied to the pair of electrodes 6 and 7, a strong electrostatic field is established and one electrode attracts the other. The flexible wall 8 and the actuator 5 are now bonded together, and vibrations of the flexible wall 8 will be driven by movements of the actuator 5. When a separate voltage $V_2$ is applied to the actuator 5 made of a piezoelectric material, the actuator 5 contracts and draws away from the chamber 1, as indicated by an arrow A. Since the first electrode 6 and the second electrode 7 are bonded by the electrostatic field, the actuator 5 pulls on and deforms the flexible wall 8 to the expanded state shown in FIG. 2A. As the flexible wall 8 deforms, the volume of the chamber 1 increases, causing the ink pressure inside the chamber 1 to decrease so that ink 2 is drawn into the chamber 1 through the inlet 3.

In the next step, the voltage $V_2$ on the actuator 5 is altered, e. g. removed, to allow the actuator 5 to rapidly return to its previous position, as indicated by an arrow B in FIG. 2B. Accordingly, the flexible wall 8 restores to its original state, compressing ink 2 trapped in the chamber 1. The increasing ink pressure inside the chamber 1 forces ink 2 out of the nozzle 4, forming an ink drop 20 which travels toward the target. Pressure transients in the chamber 1 are allowed to decay, and the voltage $V_1$ is optionally removed from the pair of the pair of electrodes 6 and 7. This completes the cycle, and the ink jet apparatus 10 is ready for the next cycle.

It is obvious to those of ordinary skill in the art that altering the voltage $V_1$ will cause the flexible wall 8 to return from the expanded state of FIG. 2A to the original state as well, jetting the ink drop 20 through the nozzle 4. This is because when the voltage $V_1$ is altered or removed, the electrostatic bond disappears or becomes sufficiently weak. The pair of electrodes 6 and 7 will then release each other, and the flexible wall 8 is free to restore to its original state.

Likewise, the flexible wall 8 will not move from the original state to the expanded state if the electrostatic bond between the first electrode 6 and the second electrode 7 is not strong enough, despite the movement of the actuator 5. As shown in FIG. 2C, when the voltage $V_2$ is applied, the actuator 5 contracts and draws away from the chamber 1, as indicated by the arrow A. However, since the voltage $V_1$ is not applied to the pair of electrodes 6 and 7 ($V_1$=0), there is no electrostatic field established and, therefore, the first electrode 6 and the second electrode 7 do not attract each other. The flexible wall 8 is not driven by the movement of the actuator 5, and the chamber 1 is at rest. Therefore, ink 2 does not rush into the chamber 1, and no ink is ejected from the nozzle 4 when the actuator 5 returns.

Figure 3:
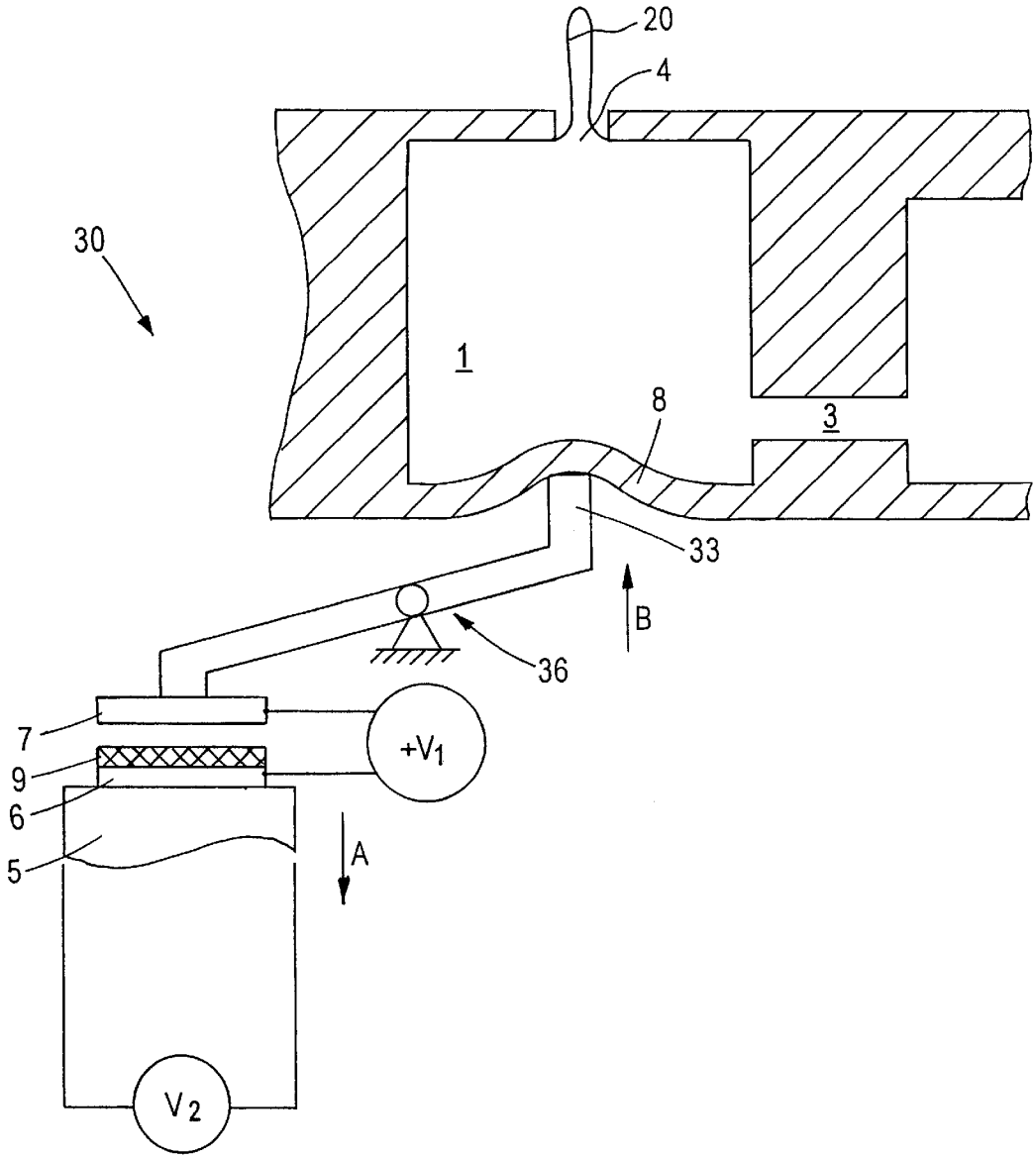
FIG. 3 is a schematic sectional view of an ink jet apparatus in accordance with another embodiment of the present invention.

Another embodiment of the present invention is depicted in FIG. 3. Most of the components of an ink jet apparatus 30 in FIG. 3 are similar to those of the ink jet apparatus 10 in FIG. 1 and need not be described again. The ink jet apparatus 30 differs from the ink jet apparatus 10 in that the second electrode 7 is not formed on the outer surface of the flexible wall 8, but instead is connected to the flexible wall 8 via a reversing mechanism, such as a lever mechanism 36.

As before, the pair of electrodes 6 and 7 attract each other in response to application of the voltage $V_1$, and the actuator 5 draws away in the direction of the arrow A in response to application of the voltage $V_2$. However, in the ink jet apparatus 30, the lever mechanism 36 reverses the deformation direction of the flexible wall 8. In particular, when the second electrode 7 is attracted by the first electrode 6 and moves in the direction of the arrow A, an arm 33 of the lever mechanism 36 moves in an opposite direction indicated by the arrow B. The arm 33 pushes the flexible wall 8 inwardly into the interior of the chamber 1, forcing ink 2 out of the nozzle 4 and forming the ink drop 20. Then, when the actuator 5 returns or when the electrostatic bond is removed, the arm 33 of lever mechanism 36 and the flexible wall 8 restore to their respective original positions. The ink pressure inside the chamber 1 decreases, causing ink 2 to rush into the chamber 1. The ink jet apparatus 30 is ready for the next cycle. This mode is known in the art as a fire-before-fill mode.

It will be contemplated by those of ordinary skill in the art that many details of the foregoing description are for exemplary purposes only. For instance, the piezoelectric material of the actuator 5 may be of a type which expands when placed under the voltage $V_2$. The actuator 5 then moves forward, instead of away from, the flexible wall 8. Another alternative is that the second electrode 7 is still formed on the flexible wall 8 while the first electrode 6 is connected to the actuator 5 via the lever mechanism 36. Moreover, the ink jet apparatus of the invention are not limited to ink jet applications but also usable in any technology which requires a fluid to be jetted from a fluid chamber.

Now, with reference to FIG. 4, an ink jet printer head 100 of the invention will be described. The ink jet printer head 100 comprises a number of ink jet apparatus which are almost identical to the ink jet apparatus 10 shown in FIG. 1 and need not be described in detail again. The difference resides in that flexible walls 58, 68, and 78 of several ink jet apparatus 50, 60, and 70 are driven by the same actuator 5. Pairs of electrodes are disposed between each of the flexible walls 58, 68, and 78 and the actuator 5. Second electrodes 57, 67, and 77 are formed respectively on each of the flexible walls 58, 68, and 78. First electrodes are formed on the edge of the actuator 5 either separately, e.g. as a first electrode 56 corresponding to the flexible wall 58, or jointly, as a first electrode 66 corresponding to the flexible walls 68 and 78. Insulators 59, 69 and 79 are arranged in a similar manner.

The ink jet printer head 100 further comprises a coupling control circuit 80 for selecting ink jet apparatus.which are to jet in a cycle. In particular, the coupling control circuit 80 generates electrostatic bonds between the actuator 5 and flexible walls of the selected ink jet apparatus only. In an embodiment of the invention, the coupling control circuit 80 is electrically connected with the first electrodes 56 and 66, and the second electrodes 57, 67, and 77 to apply the voltage $V_1$ to the selected pairs of electrodes.

Figure 4:
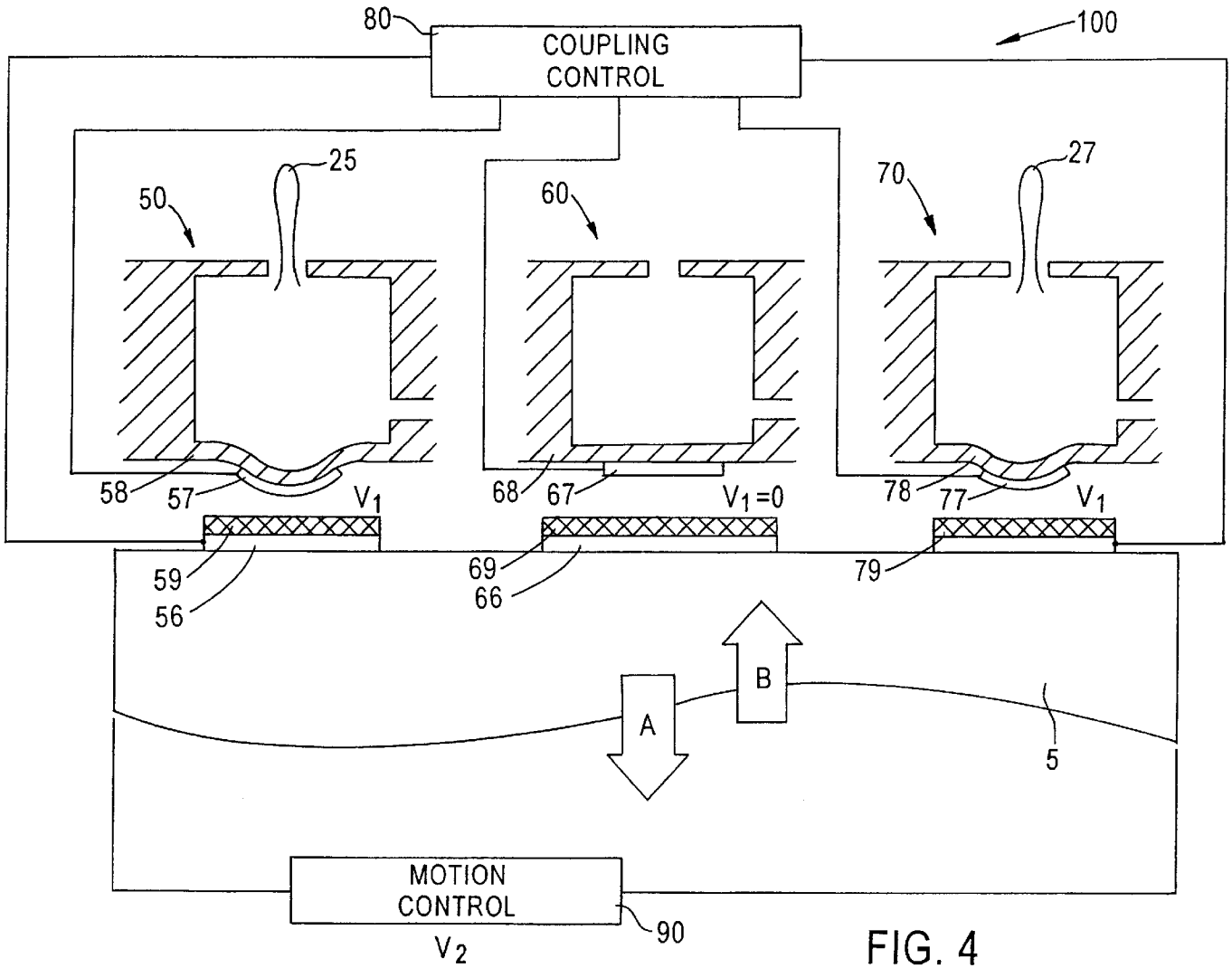
FIG. 4 is a schematic sectional view of an ink jet printer head in accordance with the present invention.

In the example shown in FIG. 4, the ink jet apparatus 50 and 70 are selected with the voltage $V_1$ applied to their pairs of electrodes, while the ink jet apparatus 60 is unselected with the voltage $V_1$=0. Electrostatic bonds are created between the flexible walls 58 and 78 and the actuator 5 of the selected ink jet apparatus 50 and 70. Accordingly, when the actuator 5 moves, in the directions indicated by the arrows A and B, the flexible walls 58 and 78 deform and return in the manner described in the discussion of FIGS. 2A and 2B. As a result, ink drops 25 and 27 are ejected by the ink jet apparatus 50 and 70. During this cycle, the unselected ink jet apparatus 60 remains dormant, in the manner described in the discussion of FIG. 2C, since its flexible wall 68 is not electrostatically bonded to the actuator 5. Preferably, the ink jet printer head 100 further includes a motion control circuit 90 for applying the voltage $V_2$ to the piezoelectric actuator 5 to cause the movements thereof.

Of particular note, the above mentioned modifications of the ink jet apparatus, such as types of piezoelectric material used for the actuator, electrode arrangements, and inclusion of reversing mechanisms, are also applicable to the ink jet apparatus of the ink jet printer head 100.

It should now be apparent that an ink jet apparatus for use in an ink jet printer head and a method of operating the same have been described. In accordance with the present invention, electrostatic attraction serves as a glue between a common actuator and a flexible wall of the fluid chamber. Thus, the conventional adhesive bonds are effectively replaced and the misalignment problem between the fluid chamber and the actuator is lessened. Moreover, a single actuator can be shared among channels to drive ink out of their respective nozzles. As the electrostatic field can be switched on and off, individual channels are selectively clamped to the actuator only when those channels are to eject drops. Thus, the actuator may be of a larger size than that of the conventional actuators, simplifying the actuator manufacturing process. Life span of the piezoelectric actuator is also improved since the time-varying printing control voltages can now be applied to the pairs of electrodes rather than to the actuator itself.

While there have been described and illustrated specific embodiments of the invention, it will be clear that variations in the details of the embodiments specifically illustrated and described may be made without departing from the true spirit and scope of the invention as defined in the appended claims.

What is claimed is:

1. A fluid jet apparatus, comprising:

a fluid chamber having a nozzle, and a flexible wall capable of vibrating to alter a volume of the fluid chamber;

an actuator for generating mechanical movements; and an electrostatic coupling disposed between the flexible wall and the actuator constructed to selectively bond the flexible wall to the actuator when sufficient voltage is applied to the coupling to transform mechanical movements of the actuator into vibrations of the flexible wall.

2. The fluid jet apparatus of claim 1, wherein the electrostatic coupling includes a first electrode located on one of an edge of the actuator and an outer surface of the flexible wall, and a second electrode located in parallel with and spaced from the first electrode.

3. The fluid jet apparatus of claim 2, wherein the second electrode is located on the other of the edge of the actuator and the outer surface of the flexible wall.

4. The fluid jet apparatus of claim 2, further including a reversing mechanism for, in cooperation with the electrostatic coupling, reversibly transforming the mechanical movements of the actuator into the vibrations of the flexible wall.

5. The fluid jet apparatus of claim 4, wherein the second electrode is attached to the reversing mechanism.

6. The fluid jet apparatus of claim 2, wherein the electrostatic coupling further includes an insulator between the first electrode and the second electrode.

7. The fluid jet apparatus of claim 2, wherein the first electrode and the second electrode attract each other when a voltage is applied thereto, providing an electrostatic bond between the flexible wall and the actuator.

8. An ink jet apparatus, comprising:

an ink chamber having a nozzle, an inlet, and a flexible wall;

an actuator moving in a first direction and a second direction; and an electrostatic coupling for providing an electrostatic bond between the flexible wall and the actuator, whereby the flexible wall is deformed to force ink out through the nozzle and to draw ink in through the inlet in response to movements of the actuator in the first direction and in the second direction, respectively.

9. The ink jet apparatus of claim 8, wherein the electrostatic coupling includes a first electrode located on one of an edge of the actuator and an outer surface of the flexible wall, and a second electrode located in parallel with and spaced from the first electrode.

10. The ink jet apparatus of claim 9, wherein the second electrode is located on the other of the edge of the actuator and the outer surface of the flexible wall.

11. The ink jet apparatus of claim 9, wherein the electrostatic coupling further includes an insulator between the first electrode and the second electrode.

12. The ink jet apparatus of claim 11, wherein the insulator is attached to one of the first electrode and the second electrode which is unattached to the outer surface of the flexible wall.

13. The ink jet apparatus of claim 12, wherein the insulator is in contact with the other of the first electrode and the second electrode.

14. The ink jet apparatus of claim 8, further including a reversing mechanism for, in cooperation with the electrostatic coupling, deforming the flexible wall to force ink out through the nozzle and to draw ink in through the inlet in response to movements of the actuator in the second direction and in the first direction, respectively.

15. The ink jet apparatus of claim 8, wherein the actuator is made of a piezoelectric material.

16. An ink jet printer head, comprising:

a plurality of ejection chambers each having a nozzle, an inlet, and a flexible wall;

at least one motion driving element;

a plurality of first electrostatic coupling members each associated with one flexible wall;

at least one second electrostatic coupling member associated with the at least one motion driving element; and a coupling control circuit for selectively generating electrostatic bonds between predetermined first electrostatic coupling members of the plurality of first electrostatic coupling members and the at least one second electrostatic coupling member, whereby only flexible walls associated with the predetermined first electrostatic coupling members are deformed to force ink out through the nozzle and to draw ink in through the inlet of their respective ejection chamber, in response to movements of the at least one motion driving element.

17. The ink jet printer head of claim 16, wherein each of the plurality of first electrostatic coupling members is a first electrode, and the at least one second electrostatic coupling member is a second electrode located in parallel with and spaced from the first electrodes.

18. The ink jet printer head of claim 17, wherein each of the first electrodes is located on an outer surface of an associated flexible wall.

19. The ink jet printer head of claim 17, wherein the second electrode is located on an edge of the at least one motion driving element.

20. The ink jet printer head of claim 17, further including an insulator layer between the first electrodes and the second electrode.

21. The ink jet printer head of claim 17, wherein the coupling control circuit selectively applies a first voltage across predetermined first electrodes and the second electrode to generate attracting electrostatic fields between each of the predetermined first electrodes and the second electrode.

22. The ink jet printer head of claim 16, wherein the at least one motion driving element is made of a piezoelectric material.

23. The ink jet printer head of claim 22, further including a motion controlling circuit for applying a second voltage across the at least one motion driving element causing the movements of the at least one motion driving element.

24. A method of operating an ink jet apparatus including an ink chamber having a nozzle, an inlet and a flexible wall, and an actuator moving in a first direction and a second direction, the method comprising the steps of:

a) generating an electrostatic bond between the flexible wall and the actuator;

b) deforming the flexible wall from a first state to a second state in response to a movement of the actuator in the first direction; and c) returning the flexible wall from the second state to the first state.

25. The method of claim 24, wherein ink is drawn in through the inlet in step b) and ink is forced out through the nozzle in step c).

26. The method of claim 24, wherein ink is forced out through the nozzle in step b) and ink is drawn in through the inlet in step c).

27. The method of claim 24, wherein step c) is performed by causing a movement of the actuator in the second direction.

28. The method of claim 24, wherein step c) is performed by removing the electrostatic bond between the flexible wall and the actuator.

29. A method of operating an ink jet printer head including a plurality of ejection chambers each having a nozzle, an inlet and a flexible wall, and at least one actuator moving in a first direction and in a second direction, the method comprising the steps of:

a) selectively generating electrostatic bonds between flexible walls of predetermined ejection chambers and the at least one actuator;

b) deforming the flexible walls of the predetermined ejection chambers from a first state to a second state in response to a movement of the at least one actuator in the first direction; and c) returning the flexible walls of the predetermined ejection chambers from the second state to the first state, thereby ink is jetted from the predetermined ejection chambers only.

30. The method of claim 29, wherein step c) is performed by at least one of removing the electrostatic bonds and causing a movement of the at least one actuator in the second direction.

* * * * *